US008475212B1

(12) United States Patent
Li et al.

(10) Patent No.: US 8,475,212 B1
(45) Date of Patent: Jul. 2, 2013

(54) CHARGING CONNECTOR

(75) Inventors: Jiang Li, New Taipei (TW); Ming-Han Lin, New Taipei (TW); Li-Jun Xu, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 3 days.

(21) Appl. No.: 13/401,760

(22) Filed: Feb. 21, 2012

(51) Int. Cl.
*H01R 13/648* (2006.01)

(52) U.S. Cl.
USPC ..... 439/607.41

(58) Field of Classification Search
USPC ..... 439/607.41–607.52
See application file for complete search history.

(56) References Cited

U.S. PATENT DOCUMENTS

| | | | | |
|---|---|---|---|---|
| 5,518,421 | A * | 5/1996 | Davis | 439/607.5 |
| 5,658,170 | A * | 8/1997 | Tan et al. | 439/607.41 |
| 5,833,495 | A * | 11/1998 | Ito | 439/607.48 |
| 6,024,606 | A * | 2/2000 | Morikawa et al. | 439/607.45 |
| 6,039,606 | A * | 3/2000 | Chiou | 439/607.45 |
| 6,165,016 | A * | 12/2000 | Lai | 439/607.41 |
| 6,210,231 | B1 * | 4/2001 | Lai | 439/607.44 |
| 6,231,393 | B1 * | 5/2001 | Lai | 439/607.44 |
| 6,280,252 | B1 * | 8/2001 | Huang | 439/607.48 |
| 6,347,964 | B1 * | 2/2002 | Kuan | 439/680 |
| 6,435,915 | B1 * | 8/2002 | Chen | 439/607.41 |
| 6,783,397 | B2 * | 8/2004 | Yang Lee | 439/607.45 |
| 6,814,615 | B2 * | 11/2004 | Laub et al. | 439/585 |
| 6,878,011 | B2 * | 4/2005 | Laub et al. | 439/585 |
| 7,470,150 | B2 * | 12/2008 | Kuo et al. | 439/607.41 |
| 7,534,143 | B1 * | 5/2009 | Tsao et al. | 439/607.41 |
| 7,717,733 | B1 * | 5/2010 | Yi et al. | 439/452 |
| 7,736,190 | B2 * | 6/2010 | Yuan et al. | 439/660 |
| 7,794,279 | B1 * | 9/2010 | Ye et al. | 439/607.54 |
| 7,815,470 | B2 * | 10/2010 | Ho | 439/607.48 |
| 7,824,221 | B2 * | 11/2010 | Miyoshi | 439/607.41 |
| 7,824,222 | B2 * | 11/2010 | Miyoshi et al. | 439/607.41 |
| 7,955,137 | B2 * | 6/2011 | Ko et al. | 439/660 |
| 8,011,960 | B2 * | 9/2011 | Xiao et al. | 439/607.56 |
| 8,123,562 | B2 * | 2/2012 | Zhou et al. | 439/607.48 |
| 8,142,226 | B2 * | 3/2012 | Xiao et al. | 439/607.56 |
| 8,303,344 | B2 * | 11/2012 | Xiao et al. | 439/607.56 |
| 2003/0139095 | A1 * | 7/2003 | Yang Lee | 439/607 |
| 2006/0121783 | A1 * | 6/2006 | Wu et al. | 439/607 |
| 2007/0042646 | A1 * | 2/2007 | Wu | 439/610 |
| 2007/0077818 | A1 * | 4/2007 | Iwakawa | 439/610 |
| 2007/0141907 | A1 * | 6/2007 | Kuo et al. | 439/607 |
| 2007/0155243 | A1 * | 7/2007 | Watanabe et al. | 439/610 |
| 2008/0009189 | A1 * | 1/2008 | Wu | 439/607 |
| 2009/0004916 | A1 * | 1/2009 | Miyoshi et al. | 439/610 |
| 2009/0017684 | A1 * | 1/2009 | Lin | 439/610 |
| 2010/0062642 | A1 * | 3/2010 | Zhang et al. | 439/607.41 |
| 2013/0078858 | A1 * | 3/2013 | Wu et al. | 439/607.41 |
| 2013/0084745 | A1 * | 4/2013 | Siahaan et al. | 439/607.41 |
| 2013/0084746 | A1 * | 4/2013 | Siahaan et al. | 439/607.41 |

* cited by examiner

*Primary Examiner* — Ross Gushi

(57) ABSTRACT

A charging connector adapted for connecting between a mated connector and a cable includes an insulating housing, a terminal and a shielding shell surrounding the insulating housing. The insulating housing has a base body, and a protruding portion protruding upward from a top surface of the base body. The insulating housing defines a terminal groove. The terminal has a locating piece located on the top surface of the base body. A front of the locating piece defines a contact piece disposed in the terminal groove with a front thereof electrically contacting with the mated connector. A rear of the locating piece defines a soldering piece disposed to a rear of the insulating housing to be soldered with the cable. A side of the shielding shell defines a soldering plate disposed to one side of the insulating housing to be soldered with the cable.

10 Claims, 5 Drawing Sheets

CHARGING CONNECTOR

BACKGROUND OF THE INVENTION

1. Field of the Invention

The present invention generally relates to a charging connector, and more particularly to a charging connector capable of assuring the working reliability thereof.

2. The Related Art

With the fast development of economy and the continuous improvement of technology, people's living standard has been improved correspondingly. In that case, more and more electronic products are developed to satisfy people's diverse consumption needs, and a variety of connectors are used in the electronic products to connect with peripherals.

In general, a charging connector adapted for connecting between a mated connector and a cable includes an insulating housing, a terminal and a shielding shell. A rear end of the terminal defines a soldering portion. A rear end of the shielding shell defines a soldering arm. The terminal is disposed in the insulating housing with the soldering portion projecting out of a rear end of the insulating housing. A front end of the shielding shell surrounds a front end of the insulating housing together with the terminal to electrically connect with the mated connector. The soldering portion of the terminal and the soldering arm of the shielding shell are located in the rear of the charging connector to be soldered with the cable.

However, there is a narrow space between the soldering arm and the soldering portion located in the rear of the charging connector that makes the soldering portion and the soldering arm solder with the cable inconveniently and further affects soldering effect of the soldering portion and the soldering arm soldering with the cable. As a result, the working reliability of the charging connector is seriously affected.

SUMMARY OF THE INVENTION

An object of the present invention is to provide a charging connector adapted for connecting between a mated connector and a cable includes an insulating housing, a terminal and a shielding shell. The insulating housing has a base body, and a protruding portion protruding upward from a top surface of the base body and then extending forward beyond a front end of the base body. The insulating housing defines a terminal groove extending longitudinally against the top surface of the base body to pass through a bottom and a rear end of the protruding portion. The terminal has a locating piece located on the top surface of the base body. A front of the locating piece extends forward to form a contact piece inserted forward into the terminal groove with a front thereof being exposed under the protruding portion to electrically contact with the mated connector. A rear of the locating piece defines a soldering piece disposed to a rear of the insulating housing to be soldered with the cable. The shielding shell surrounds the insulating housing. A side of the shielding shell defines a soldering plate disposed to one side of the insulating housing to be soldered with the cable.

As described above, the soldering piece of the terminal is disposed to the rear of the insulating housing and the soldering plate of the shielding shell is disposed to one side of the insulating housing to expand soldering space between the soldering piece and the soldering plate. So that, on one hand, the soldering piece and the soldering plate solder with the cable conveniently, and on the other hand, the soldering effect of the soldering piece and the soldering plate soldering with the cable is improved. As a result, the working reliability of the charging connector is assured.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
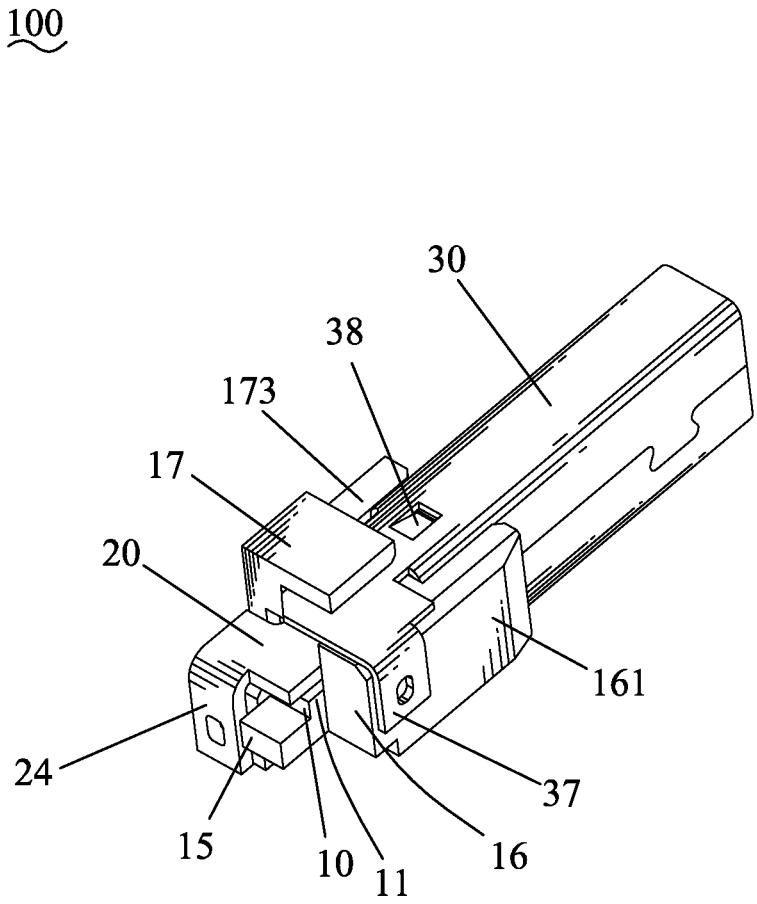
FIG. 1 is a perspective view of a charging connector in accordance with the present invention.
Figure 2:
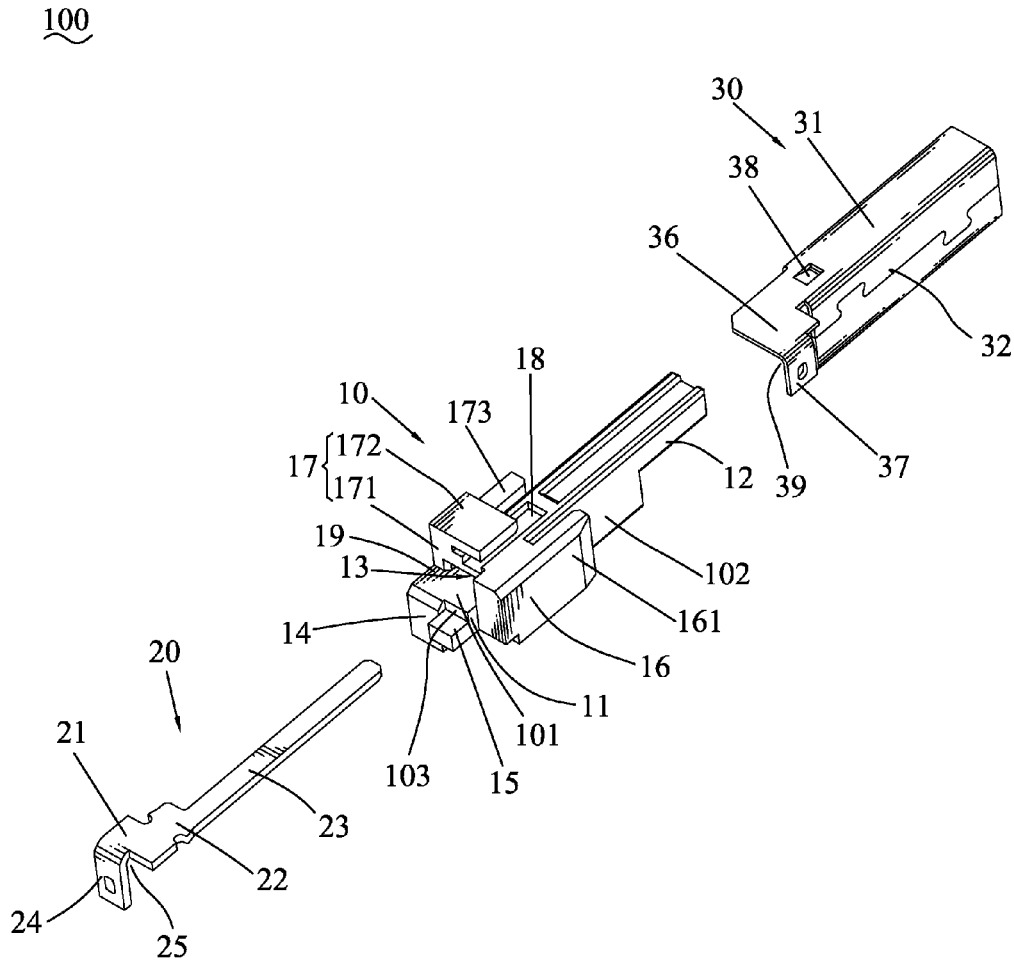
FIG. 2 is an exploded view of the charging connector of FIG. 1.

With reference to FIG. 1 and FIG. 2, a charging connector 100 in accordance with the present invention is shown. The charging connector 100 adapted for connecting between a mated connector (not shown) and a cable (not shown) includes an insulating housing 10, a terminal 20 and a shielding shell 30.

Figure 3:
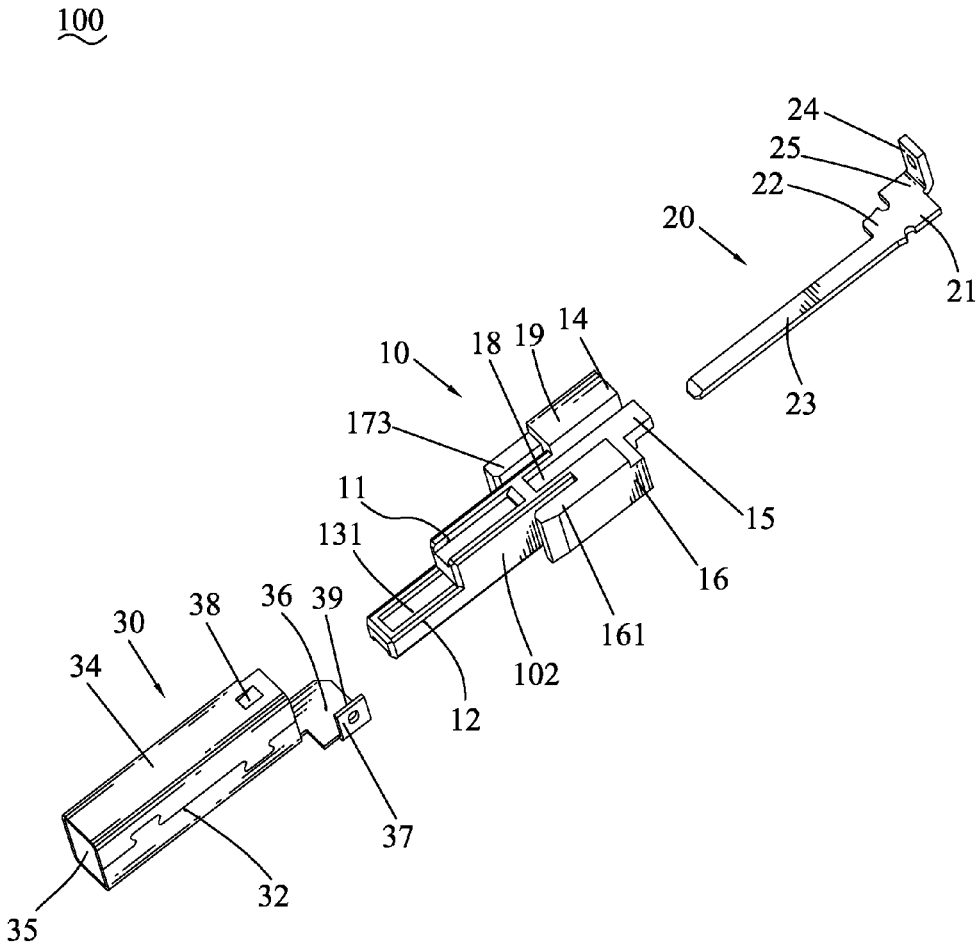
FIG. 3 is another exploded view of the charging connector of FIG. 1.
Figure 4:
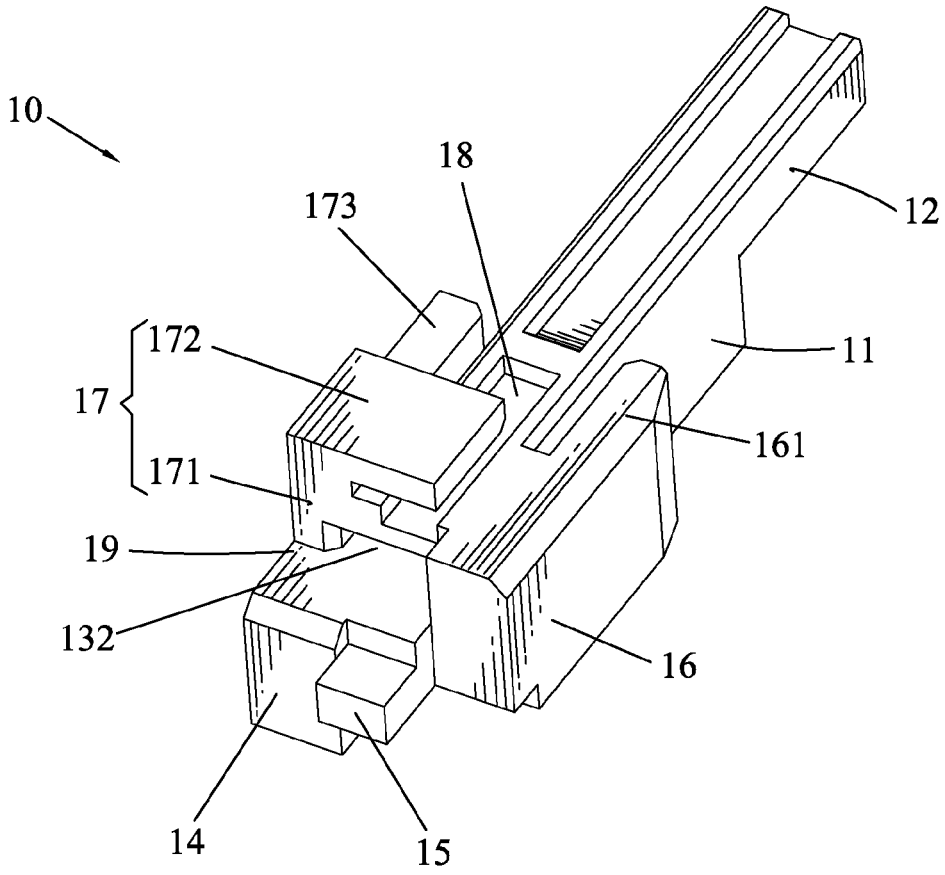
FIG. 4 is a perspective view of an insulating housing of the charging connector of FIG. 2.

Referring to FIG. 2, FIG. 3 and FIG. 4, the insulating housing 10 has a base body 11, and a protruding portion 12 protruding upward from a front of a top surface 101 of the base body 11 and then extending forward beyond a front end of the base body 11. A first propping portion 14 connects with one side of a rear surface 103 of the base body 11 and extends beyond a bottom of the base body 11. A rear of one side surface 102 of the insulating housing 10 away from the first propping portion 14 protrudes outward and then extends rearward to form a second propping portion 16. A lower portion of the other side of the rear surface 103 of the base body 11 protrudes rearward to form a blocking portion 15 located between the first propping portion 14 and the second propping portion 16. An L-shaped auxiliary block 19 seen from a front view encloses a rear end of one side face of the base body 11 and a rear end of one side of the bottom of the base body 11, and connects with the first propping portion 14. One outer side of the second propping portion 16 extends forward to form a first clipping portion 161 facing to the corresponding side surface 102 and spaced from the corresponding side surface 102. A front of a top face of the auxiliary block 19 protrudes beyond a top of the protruding portion 12 to form a first arm 171. A free end of the first arm 171 bends horizontally to form a second arm 172 located above the top of the protruding portion 12 and spaced from the top of the protruding portion 12. The first arm 171 and the second arm 172 together define an inverted L-shaped clamping portion 17. A middle of a front of a junction of the first arm 171 of the clamping portion 17 and the auxiliary block 19 extends forward to form a second clipping portion 173 facing to the corresponding side surface 102 and spaced from the corresponding side surface 102. The first clipping portion 161 is symmetrical to the second clipping portion 173 about the base body 11 and the protruding portion 12 along a longitudinal direction of the insulating housing 10.

The insulating housing 10 defines a terminal groove 13 which includes a passage 131 extending longitudinally against the top surface 101 of the base body 11 to pass through a front of a bottom of the protruding portion 12, and a fastening slot 132 passing through a rear end of the bottom of the protruding portion 12 and a bottom of an inner side of the first arm 171, and communicating with the passage 131. The terminal groove 13 faces to the top surface 101. A rear of the top of the protruding portion 12 and a rear of the bottom of the base body 11 respectively define a buckling groove 18.

Referring to FIG. 2 and FIG. 3, the terminal 20 has a locating piece 21. One side of a front of the locating piece 21 connects with a fastening piece 22. One side of a front of the fastening piece 22 away from the other side of the front of the locating piece 21 extends forward to form a contact piece 23. One side of a rear of the locating piece 21 opposite to the other side of the front of the locating piece 21 is bent downward to form a soldering piece 24. A receiving space 25 is formed between the locating piece 21 and the soldering piece 24, and the locating piece 21 and the soldering piece 24 show a right angle shape.

Figure 5:
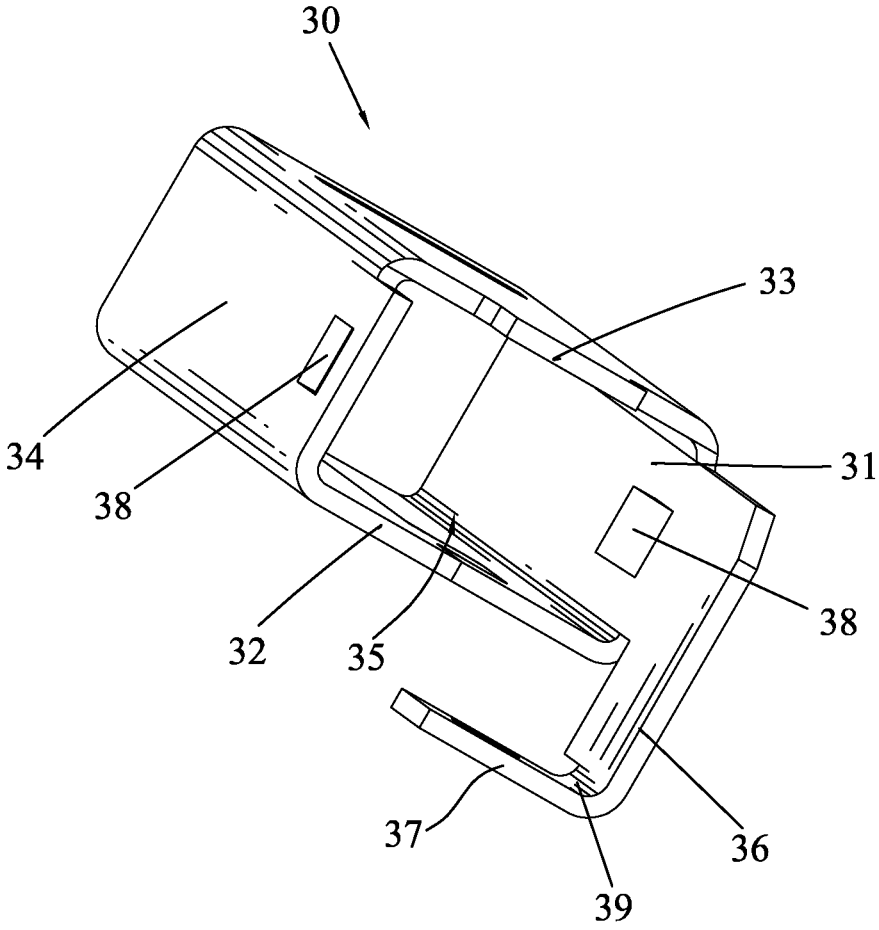
FIG. 5 is a perspective view of a shielding shell of the charging connector of FIG. 2.

Referring to FIG. 2, FIG. 3 and FIG. 5, the shielding shell 30 has a top plate 31, a first side plate 32 and a second side plate 33 extending downward from two opposite sides of the top plate 31, and a bottom plate 34 connecting with the first side plate 32 and the second side plate 33. An accommodating space 35 is surrounded among the top plate 31, the first side plate 32, the second side plate 33 and the bottom plate 34. A rear end of the top plate 31 extends rearward and then extends sideward to form an L-shaped locating plate 36 from a top view. A rear of a free end of the locating plate 36 is bent downward to form a soldering plate 37 away from the second side plate 33. A holding space 39 is formed between the locating plate 36 and the soldering plate 37, and the locating plate 36 and the soldering plate 37 show the right angle shape. Two buckling portions 38 are punched inward from the rear end of the top plate 31 and a rear end of the bottom plate 34, respectively.

Referring to FIGS. 1-5, when the charging connector 100 is assembled, the terminal 20 is assembled to the terminal groove 13 of the insulating housing 10. The contact piece 23 is inserted forward into the passage 131 with a front thereof being exposed under the protruding portion 12 to electrically contact with the mated connector. The fastening piece 22 is fastened in the fastening slot 132. The locating piece 21 is located on the top surface 101 and the top face of the auxiliary block 19. The first propping portion 14 is received in the receiving space 25 of the terminal 20. The soldering piece 24 is propped up by a rear of the first propping portion 14 for preventing the soldering piece 24 from being deformed during a process of molding plastic around the charging connector 100.

A front end of the insulating housing 10 together with the front end of the contact piece 23 is inserted into the accommodating space 35 of the shielding shell 30 to electrically contact with the mated connector. The buckling portions 38 are buckled in the buckling grooves 18. The first side plate 32 is inserted into an interval between the first clipping portion 161 and the corresponding side surface 102 facing to the first clipping portion 161, and is clipped between the first clipping portion 161 and the corresponding side surface 102 facing to the first clipping portion 161. The second side plate 33 is inserted into an interval between the second clipping portion 173 and the corresponding side surface 102 facing to the second clipping portion 173, and is clipped between the second clipping portion 173 and the corresponding side surface 102 facing to the second clipping portion 173. The locating plate 36 is clamped between the top of the protruding portion 12 and the clamping portion 17. So that the shielding shell 30 is fastened to the insulating housing 10 firmly. The second propping portion 16 is received in the holding space 39 of the shielding shell 30. The soldering plate 37 is propped up by the second propping portion 16 for preventing the soldering plate 37 from being deformed during the process of molding the plastic around the charging connector 100.

The soldering piece 24 of the terminal 20 is bent from the one side of the rear of the locating piece 21 and the soldering plate 37 of the shielding shell 30 is bent from the rear of the free end of the locating plate 36 to expand soldering space between the soldering piece 24 and the soldering plate 37 so as to make the soldering piece 24 and the soldering plate 37 solder with the cable conveniently and improve soldering effect of the soldering piece 24 and the soldering plate 37 soldering with the cable. The bending structure of the soldering piece 24 and the soldering plate 37 reduce an occupying space of the charging connector 100. The blocking portion 15 is located between the soldering piece 24 propped by the rear of the first propping portion 14 and the soldering plate 37 propped by the second propping portion 16 to effectively block the soldering piece 24 and the soldering plate 37 for contacting with each other so as to prevent a short circuit generating between the soldering piece 24 and the soldering plate 37, if the soldering piece 24 and the soldering plate 37 are deformed in the process of molding the plastic around the charging connector 100.

As described above, the soldering piece 24 of the terminal 20 is bent from the one side of the rear of the locating piece 21 and is propped up by the rear of the first propping portion 14 of the insulating housing 10, and the soldering plate 37 of the shielding shell 30 is bent from the rear of the free end of the locating plate 36 and is propped up by the second propping portion 16 of the insulating housing 10 to expand soldering space between the soldering piece 24 and the soldering plate 37. So that, on one hand, the soldering piece 24 and the soldering plate 37 solder with the cable conveniently, and on the other hand, the soldering effect of the soldering piece 24 and the soldering plate 37 soldering with the cable is improved. As a result, the working reliability of the charging connector 100 is assured.

What is claimed is:

1. A charging connector adapted for connecting between a mated connector and a cable, comprising:

an insulating housing having a base body, and a protruding portion protruding upward from a top surface of the base body and then extending forward beyond a front end of the base body, the insulating housing defining a terminal groove extending longitudinally against the top surface of the base body to pass through a bottom and a rear end of the protruding portion;

a terminal having a locating piece located on the top surface of the base body, a front of the locating piece extending forward to form a contact piece inserted forward into the terminal groove with a front thereof being exposed under the protruding portion to electrically contact with the mated connector, a rear of the locating piece defining a soldering piece disposed to a rear of the insulating housing to be soldered with the cable; and a shielding shell surrounding the insulating housing, a side of the shielding shell defining a soldering plate disposed to one side of the insulating housing to be soldered with the cable.

2. The charging connector as claimed in claim 1, wherein the rear of the locating piece is bent downward to form the soldering piece with a receiving space being formed between the locating piece and the soldering piece, a first propping portion connects with a rear surface of the base body and extends beyond a bottom of the base body, the first propping portion is received in the receiving space to prop up the soldering piece.

3. The charging connector as claimed in claim 2, wherein the locating piece and the soldering piece show a right angle shape.

4. The charging connector as claimed in claim 2, wherein the shielding shell has a top plate, a rear end of the top plate extends rearward and then extends sideward to form a locating plate, a free end of the locating plate is bent downward to form the soldering plate with a holding space being formed between the locating plate and the soldering plate, one side surface of the insulating housing away from the first propping portion protrudes outward and then extends rearward to form a second propping portion received in the holding space and propping up the soldering plate.

5. The charging connector as claimed in claim 4, wherein the locating plate and the soldering plate show a right angle shape.

6. The charging connector as claimed in claim 2, wherein a lower portion of the rear surface of the base body protrudes rearward to form a blocking portion located between the soldering piece and the soldering plate.

7. The charging connector as claimed in claim 1, wherein two opposite sides of the insulating housing define a first clipping portion and a second clipping portion spaced from the corresponding sides of the insulating housing for clipping two opposite side plates of the shielding shell.

8. The charging connector as claimed in claim 7, wherein the first clipping portion is symmetrical to the second clipping portion about the base body and the protruding portion along the longitudinal direction of the insulating housing.

9. The charging connector as claimed in claim 1, wherein a top of the insulating housing defines an inverted L-shaped clamping portion of which a top is spaced from a top of the protruding portion for clamping a rear end of a top of the shielding shell.

10. The charging connector as claimed in claim 1, wherein a periphery of the insulating housing defines at least two buckling grooves for buckling at least two buckling portions accordingly protruding at a periphery of the shielding shell.

* * * * *